US011703297B2

(12) United States Patent
Seigler

(10) Patent No.: US 11,703,297 B2
(45) Date of Patent: Jul. 18, 2023

(54) DRY FIRE PRACTICE TRAINING DEVICE WITH BOLT CARRIER GROUP FOR RIFLES

(71) Applicant: Stanley Hahn Seigler, Kamiah, ID (US)

(72) Inventor: Stanley Hahn Seigler, Kamiah, ID (US)

( * ) Notice: Subject to any disclaimer, the term of this patent is extended or adjusted under 35 U.S.C. 154(b) by 405 days.

(21) Appl. No.: 16/799,162

(22) Filed: Feb. 24, 2020

(65) Prior Publication Data

US 2021/0262752 A1 Aug. 26, 2021

(51) Int. Cl.
*F41A 33/00* (2006.01)
*F41G 3/26* (2006.01)
*F41A 19/06* (2006.01)

(52) U.S. Cl.
CPC ..... *F41A 33/00* (2013.01); *F41A 19/06* (2013.01); *F41G 3/26* (2013.01)

(58) Field of Classification Search
CPC ..... F41A 33/00; F41A 19/06; F41G 33/26
See application file for complete search history.

(56) References Cited

U.S. PATENT DOCUMENTS 2,353,516 A * 7/1944 Sochaczewski ..... F41G 3/26 124/39
2,722,776 A * 11/1955 Lewis ..... A63H 5/00 472/56
3,141,450 A * 7/1964 Hirsch ..... F41C 3/08 124/2
4,114,080 A * 9/1978 Greenwood ..... A63H 33/36 446/454
4,657,511 A 4/1987 Allard
4,725,235 A * 2/1988 Schroeder ..... F41A 33/06 434/18
4,737,106 A 4/1988 Laciny
4,804,325 A 2/1989 Willits
4,830,617 A * 5/1989 Hancox ..... F41A 33/02 434/21
4,955,812 A * 9/1990 Hill ..... F41G 3/2611 434/18
5,451,162 A 9/1995 Parsons
5,680,724 A * 10/1997 Peterken ..... F41A 17/44 42/70.11
5,993,215 A 11/1999 Kotsiopoulos
6,470,615 B1 * 10/2002 Peterken ..... F41A 17/44 42/70.11
6,547,627 B1 * 4/2003 Oathout ..... B63B 25/002 446/208

(Continued)

*Primary Examiner* — Melba Bumgarner
*Assistant Examiner* — Amir A Klayman

(57) ABSTRACT

When a semi-automatic rifle is live fired, it is ready to be fired again. The shooter's hands remain in the firing position, and just the trigger finger and trigger are employed. But with dry fire practice, the shooter must cycle the rifle's bolt to reset the firing pin. The shooter must move one hand from the shooting position on the rifle, the rifle's long bolt is pulled back to reset the firing pin, the rifle repositioned, a new sight picture acquired, and then the next trigger press can be accomplished. This invention replaces the rifle's bolt carrier group and provides realistic muscle memory training by duplicating the action of the trigger, the feel and the sound of the release of the firing pin, and the resetting of the trigger for additional trigger activations. The invention does not interact with the rifle's firing pin.

6 Claims, 2 Drawing Sheets

(56) References Cited

U.S. PATENT DOCUMENTS

| | | | | |
|---|---|---|---|---|
| 6,571,500 | B2 * | 6/2003 | Keenan | F41C 3/06 434/16 |
| 7,581,954 | B2 * | 9/2009 | Schavone | F41A 33/06 434/21 |
| 7,753,679 | B1 * | 7/2010 | Schuetz | F41A 33/00 42/49.02 |
| 7,841,118 | B2 * | 11/2010 | VanVlymen | F41A 3/12 42/70.11 |
| 9,182,189 | B2 | 11/2015 | Seigler | |
| 9,207,027 | B1 * | 12/2015 | Hannan | F41A 19/14 |
| 9,395,134 | B2 * | 7/2016 | Swensen | F41A 19/12 |
| 9,474,987 | B1 * | 10/2016 | Lund | H04R 1/028 |
| 9,746,272 | B2 * | 8/2017 | Lowrance | F41A 33/02 |
| 9,746,273 | B2 * | 8/2017 | Lowrance | F41A 33/06 |
| 9,939,226 | B2 * | 4/2018 | Seymore | F41A 3/12 |
| 10,775,125 | B1 * | 9/2020 | Owen, Jr. | F41A 33/00 |
| 11,333,457 | B1 * | 5/2022 | DeVoe | F41A 17/76 |
| 2004/0137411 | A1 * | 7/2004 | Kemp | F41G 3/2655 434/18 |
| 2011/0281242 | A1 * | 11/2011 | Charles | F41A 33/02 434/16 |
| 2012/0129136 | A1 * | 5/2012 | Dvorak | F41A 33/02 434/18 |
| 2016/0187095 | A1 * | 6/2016 | Liao | F41A 19/10 434/16 |
| 2017/0146311 | A1 * | 5/2017 | Tucker | F41A 17/74 |
| 2021/0247160 | A1 * | 8/2021 | Packes, Jr. | F41A 33/00 |

* cited by examiner

DRY FIRE PRACTICE TRAINING DEVICE WITH BOLT CARRIER GROUP FOR RIFLES

CROSS-REFERENCE TO RELATED APPLICATIONS

NOT APPLICABLE

STATEMENT REGARDING FEDERALLY SPONSORED RESEARCH OR DEVELOPMENT

NOT APPLICABLE

REFERENCE TO A SEQUENCE LISTING, A TABLE, OR A COMPUTER PROGRAM, LISTING COMPACT DISK APPENDIX

NOT APPLICABLE

BACKGROUND OF THE INVENTION

Live firing is the best way to practice firing a weapon. The practice process builds muscle memory and helps the shooter develop proper techniques of delivery and complete weapon control. There are several negatives of this type of practice. Using ammunition is an ongoing expense, and measures have to be taken to practice with safety. This could mean traveling to a firing range, providing safety equipment for the shooter and possibly others, and allotting special time in the schedule for the practice session.

Dry fire practice is a good substitute for live fire practice and could be considered better than live fire. Dry firing is another process of building muscle memory whereby a firearm is presented, aimed, and fired without using live ammunition. This enables the practice of firing a weapon to proceed smoothly and accurately without all of the negatives of live fire practice. Because no live ammunition is used, there is no ongoing expense, there is no need to use safety equipment, a special shooting environment is not necessary, and practicing can be accomplished in much less time.

Dry firing also allows the shooter to practice in the actual environment where the weapon may need to be used for protection such as in the home. With complete safety, actual shooting scenarios can be practiced in and around the home.

Practicing at the range can also be improved with a dry fire device. When live fire is practiced at the range, the novice shooter usually has to spend a significant amount of time and expend a lot of ammunition getting accustomed to the report and recoil of the weapon. Before live practice begins, some dry fire practicing can be done. This gets the shooter accustomed to the trigger feel before having to deal with the recoil and the report of live firing.

A major negative factor occurs with the standard method of dry firing because when a semi-automatic weapon is live fired, it resets its firing pin and is ready to be fired again until the magazine is empty. The shooter's hands remain in the firing position, and just the trigger finger and the trigger are employed. With normal dry fire practice, after the first activation of the trigger releasing the firing pin, the shooter must remove a hand from the weapon and ratchet the bolt back in order to reset the firing pin. The shooter can then let the trigger return to its unfired position and then weapon is then ready for another trigger activation. This must be done each time a shot is simulated. Doing this teaches improper muscle memory because it is not at all what happens during actual live fire.

Another negative for standard dry fire practice is that there is concern as to wear and tear on the constant releasing of a weapon's firing pin without it having the cushioning effect of the firing pin striking a round of ammunition.

Here are a few examples of weapon training patents:

U.S. Patent Documents:

U.S. Pat. No. 5,993,215 Nov. 30, 1999 Jansen; Kotsiopoulos

U.S. Pat. No. 4,657,511 Apr. 14, 1987 Allard; Briard; Saunier

U.S. Pat. No. 4,725,235 Feb. 16, 1988 Schroeder; Osborne

U.S. Pat. No. 4,737,106 Apr. 12, 1988 Laciny

U.S. Pat. No. 4,804,325 Feb. 14, 1989 Willits; Kleeman; Willits

U.S. Pat. No. 5,451,162 Sep. 19, 1995 Parsons

2011/0047847 A1 Mar. 2011 Hughes et al 42/1.01

2011/0306020 A1 Dec. 2011 Peterson 434/18

Negative qualities of these devices or systems are that they are either user intensive and/or expensive to purchase or don't address the solution in the unique way that this design does.

There is also my previous patent that is specifically for hand guns: U.S. Pat. No. 9,182,189, B2 Nov. 10, 2015 Seigler and another patent applied for by Seigler, this inventor, that is for rifles that solves this problem with a different design. This previous design replaces the standard trigger of a rifle. If the standard trigger has not already been replaced, it can be difficult to remove the holding pins and control the spring loaded parts. Then, after the training session is over, these parts can be a challenge to replace. Additionally, the shooter may not want to replace his special trigger for the dry fire training session.

There is therefore a need for a dry fire training device that allows for precise muscle memory training that is designed for rifles, is simple to operate, prevents the firing pin of the weapon from being damaged, provides for safe on-site home training, and can allow the shooter to use the trigger that is already installed in his rifle.

BRIEF SUMMARY OF THE INVENTION

The invention that is to be described accomplishes the most important aspects of dry fire training specifically for rifles: no live ammunition is used providing safety and no on going expense, convenience of practicing in the home environment where the protective rifle would most likely be used, minimal disassembling and reassembling of any of the rifle's components, the realistic feel of the trigger during the firing process and the trigger reset, precise muscle memory training using only the trigger finger motion, does not negatively affect the rifle's firing pin and hammer, and allows for the shooter to use his stock or custom trigger assembly. This invention also helps the novice shooter train with his rifle before having to deal with the recoil and the report of firing live ammunition. This invention is simple to use, provides realistic feel of the trigger operation, produces a sound that simulates the release and reset of the rifle's firing pin, and does not require major alterations to the rifle. This invention is simple to install by removing the bolt carrier group that houses the rifle's firing pin, inserting the dry fire components that are the same basic shape of the blot carrier group, inserting a member that immobilizes the rifle's hammer, and inserting another member that transfers the trigger's movement to the bolt group assembly, then practice can begin. It requires minimal alteration to the rifle before and after practice. The new bolt carrier group houses a lever which has a detente reed mounted to it which snaps when the trigger is activated. This new device functions completely independent of the rifle's firing pin because the rifle's bolt containing the firing pin is removed and replaced with the new device assembly.

There is no way that this device can mechanically activate any live ammunition.

BRIEF DESCRIPTION OF THE SEVERAL VIEWS OF THE DRAWINGS

FIG. 1-A illustrates an end view of the cylinder showing a recessed plug with a cylindrical depression for one end of one of the coil springs.

FIG. 2-A illustrates an end view of the plunger showing a cylindrical depression for one end of one of the coil springs.

DETAILED DESCRIPTION OF THE INVENTION

Figure 1:
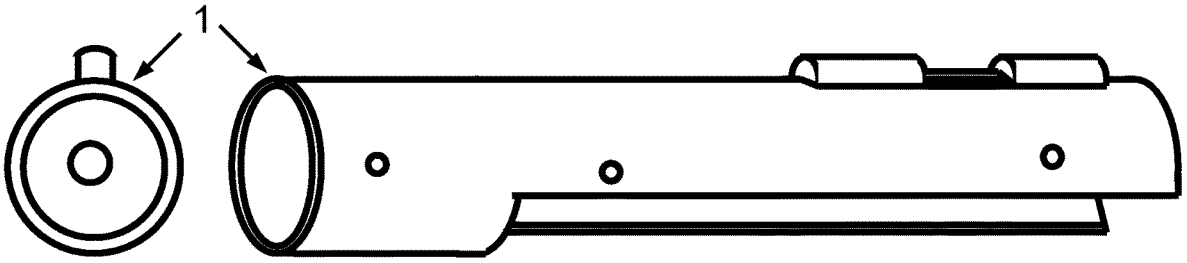
FIG. 1 illustrates an isometric view of a cylinder with various holes and cutaways.

FIG. 1 illustrates an isometric view of the cylinder 1 with a lower section removed, three pairs of holes to mount other parts, an upper raised section for maintaining the position of the cylinder 1 in the rifle's BCG compartment with a mid section for mounting the regulating screw 8 for adjusting the detente reed 3.

FIG. 1-A illustrates an end view of the cylinder 1 showing an internal plug with a cylindrical hole for one of the coil springs 4.

Figure 2:
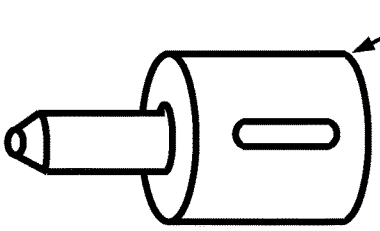
FIG. 2 illustrates an isometric view of a plunger.

FIG. 2 illustrates an isometric view of the plunger 2 with a through slot for one of the fulcrum pins 9 to pass through for limiting the back and forth motion of the plunger 2, and a smaller projection from one end which locates into the chamber of the rifle thus positioning the cylinder 1 in the rifle's BCG's compartment.

FIG. 2-A illustrates the opposite end of the plunger 2 showing a cylindrical hole for locating one end of one of the coil springs 4.

Figure 3:
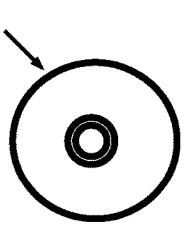
FIG. 3 illustrates a detente reed.
Figure 3:
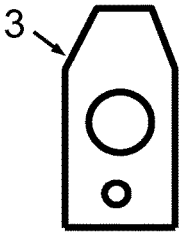

FIG. 3 illustrates the detente reed 3 that supplies the snap sound and the tactile feel of the simulated release of the rifle's firing pin.

Figure 4:
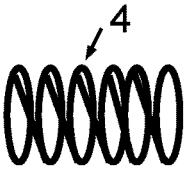
FIG. 4 illustrates an isometric view of a coil spring.

FIG. 4 illustrates one of the coil springs 4, one of which returns the lever 5 assembly to its resting position when the trigger is released, another for extending the plunger 2 for locating the device into the chamber of the rifle.

Figure 5:
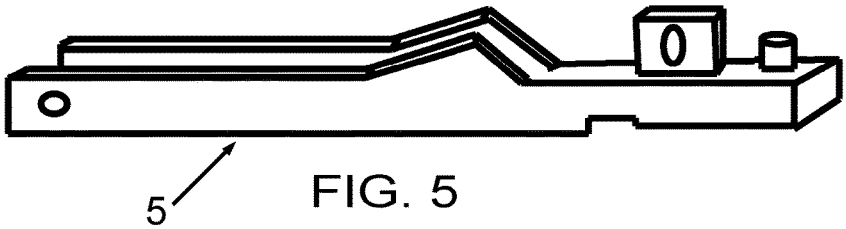
FIG. 5 illustrates an isometric view of a lever.

FIG. 5 illustrates the lever 5 with a pair of holes for the lever 5 to swing on the fulcrum pin 9, a pair of inclined ramps for mounting the detente reed 3, a rectangular projection that houses a slotted hole to guide the lever 5 in its up and down motion and limited in its motion by the fulcrum pin 9, and a small raised cylindrical projection to retain one end of one of the coiled springs 4.

Figure 6:
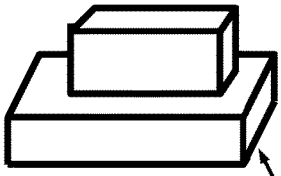
FIG. 6 illustrates an isometric view of a hammer block.

FIG. 6 illustrates the hammer keeper 6 which prevents the trigger hammer from falling when the trigger is activated.

Figure 7:
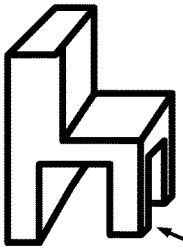
FIG. 7 illustrates an isometric view of a transfer block.

FIG. 7 illustrates the transfer block 7 which transfers the up and down movement of the trigger to the lower side of the lever 5.

Figure 8:
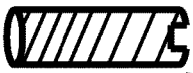
FIG. 8 illustrates an isometric view of a set screw.

FIG. 8 illustrates the set screw 8 that is used to regulate when in the movement of the lever 5 assembly that the detente reed 3 activates.

Figure 9:
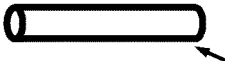
FIG. 9 illustrates an isometric view of a hinge pin.

FIG. 9 illustrates the fulcrum pin 9 that pins the various parts together and/or allows for the controlled movement of these parts.

Figure 10:
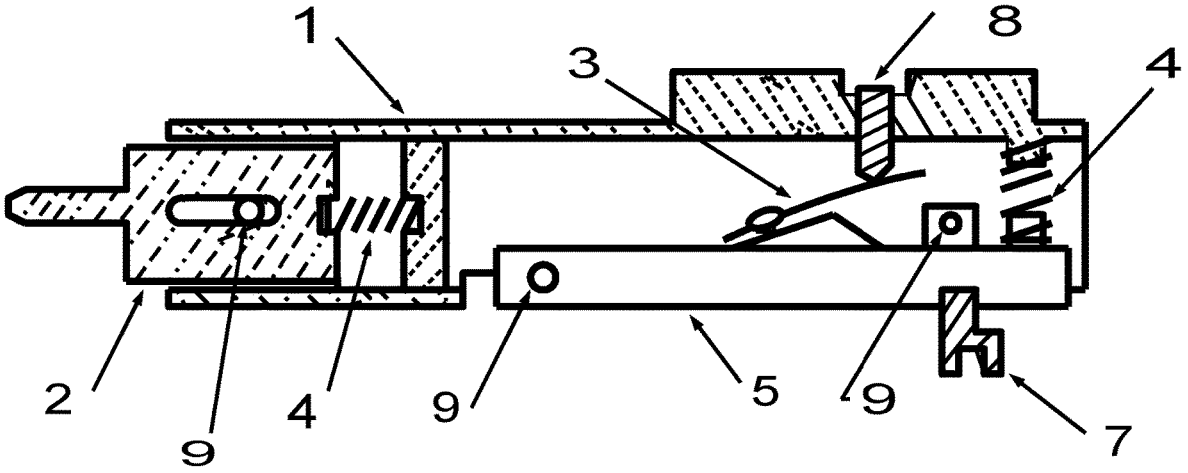
FIG. 10 illustrates a middle sectional view of an assembly of the bolt carrier group in its resting position.

FIG. 10 illustrates a sectional drawing of the assembled bolt carrier group consisting of the cylinder 1 to house the various parts comprised of the spring loaded plunger 2 which locates the front end of the device in the rifle, the lever 5 which has the detente reed 3 secured to its top surface providing the tactile and audible simulation of the rifle's firing pin release and reset, a projection for one end of the coil springs 4 which returns the lever 5 to its resting position. The cylinder 1 also has the setscrew 8 which allows for the adjusting of the position when the detente reed 3 snaps, simulating the release and reset of the rifle's firing pin.

Figure 11:
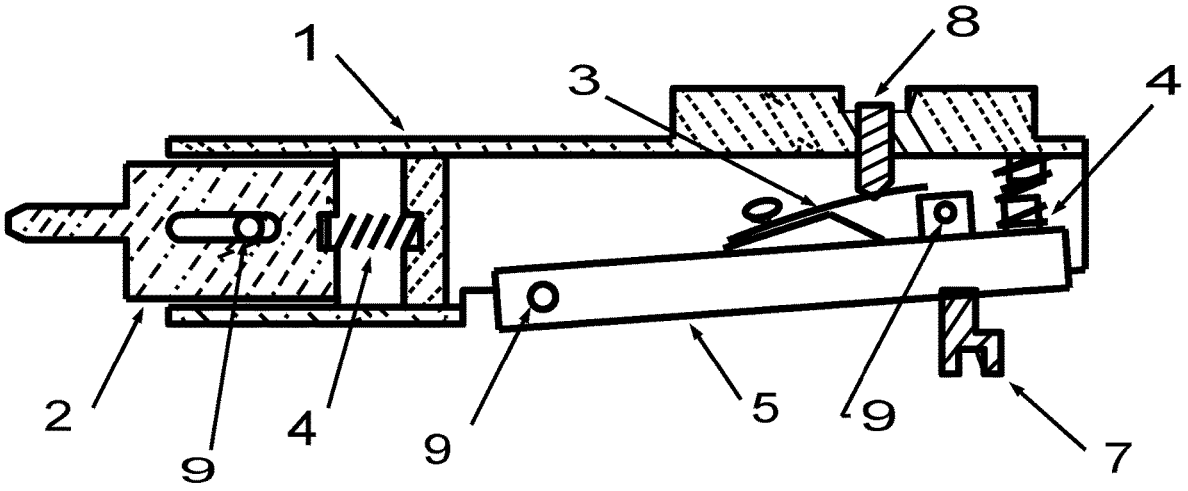
FIG. 11 illustrates a middle sectional view of an assembly of the bolt carrier group in its activated position.

FIG. 11 illustrates a sectional drawing of the assembled bolt carrier group in its activated position showing the lever 5 raised, the detente reed 3 bent and activated, and the transfer block 7 raised.

I claim:

1. A dry fire training device for a semi-automatic rifle that defines a bolt carrier group compartment that carries a bolt carrier group therein, and wherein the bolt carrier group, carried in the bolt carrier group compartment, moves reciprocally between a first position proximate a rifle stock, and a second position, proximate a rifle barrel and opposite the rifle stock, and the bolt carrier group operatively communicates with a trigger of the semi-automatic rifle, and the trigger of the semi-automatic rifle operatively communicates with a hammer which operatively communicates with a firing pin of the semi-automatic rifle, the dry fire training device comprising:

a cylinder that forms a generally cylindrical housing, that is elongate and which has a first end portion, a second end portion, an upper section, a lower section and a mid-section and which defines a generally cylindrical bore between the first end portion and the second end portion, and the lower section of the cylindrical housing defines a partial circumferential cut-out that begins at the second end portion and extends toward the first end portion but does not communicate with the first end portion, and the upper section carries a protuberance proximate the second end portion and opposite the circumferential cut-out for alignment of the cylindrical housing in the bolt carrier group compartment;

a plunger axially movably carried in the cylindrical bore of the cylindrical housing at the first end portion thereof, the plunger having a protuberance that extends axially outwardly from the plunger, and opposite the cylindrical bore, and the plunger further defines a diametrically extending through slot for a fulcrum pin that extends therethrough to movably secure the plunger at least partially within the cylindrical bore of the cylindrical housing, and at the first end portion thereof, and the plunger is biased away from the second end portion of cylindrical housing by a spring, so as to align and positionally maintain the cylinder within the rifle's bolt carrier group compartment;

a lever that is elongate and the lever has a first end portion, a second end portion, a top surface and a bottom surface and the lever is pivotally interconnected to the cylindrical housing within the cut-out portion, and the lever is movable between a resting position and an activated position relative to the cylindrical housing by pivoting upon a fulcrum pin that pivotally interconnects the first end portion of the lever to the cylindrical housing within the circumferential cut-out, and an inclined ramp is carried on the top surface of the lever between the first end portion of the lever and the second end portion of the lever, and a raised cylindrical projection is carried on the top surface of the lever proximate the second end portion of the lever to engage with a spring that biases the lever toward the resting position, and a rectangular projection is carried on the top surface of the lever between the raised cylindrical projection and a proximate end portion of the inclined ramp, the rectangular projection defining a transversely aligned slotted hole therein;

a detent reed carried on the inclined ramp of the lever, the detent reed formed of a resilient metal which emits an audible and tactile simulation that replicates a release and reset of the semi-automatic rifle firing pin when the lever is moved between the resting position and the activated position responsive to activation of the semi-automatic rifle trigger and return of the rifle trigger to an unfired position;

a transfer block operatively communicating between the semi-automatic rifle trigger and the bottom surface of the lever proximate the second end portion of the lever, for transferring movement of the semi-automatic rifle's trigger to the lever and to cause the lever to pivot between the resting position and the activated position; and a hammer block releasably carried within the semi-automatic rifle and communicating with the hammer of the semi-automatic rifle so that the semi-automatic rifle trigger is movable without activating the hammer; and the dry fire training device is installed in the bolt carrier group compartment of the semi-automatic rifle and replaces the semi-automatic rifle's bolt carrier group for dry fire practice training.

2. The dry fire training device as claimed in claim 1 and further comprising:

a transversely extending through hole defined in the cylindrical housing for carriage of a pin to interconnect movable components to the cylindrical housing.

3. The dry fire training device as claimed in claim 1 and wherein the inclined ramp carried on the top surface of the lever is comprised of two angled projections for mounting the detente reed.

4. The dry fire training device as claimed in claim 1 and further comprising:

a machine set screw carried in a threaded hole defined in the upper section of the cylindrical housing, and the machine set screw provides a means of regulating when the detente reed activates to simulate a release and reset of the semi-automatic rifle's firing pin.

5. The dry fire training device as claimed in claim 1 and wherein the springs are coil compression springs, and one coil compression spring provides a downward force to return the lever to the resting position; and a second coil compression spring biases the axially movable plunger toward the first end portion of the cylinder to align the dry fire training device in the semi-automatic rifle's bolt carrier group compartment.

6. The dry fire training device as claimed in claim 1 and wherein the transfer block frictionally communicates with the semi-automatic rifle's trigger, and moves up and down responsive to movement of the semi-automatic rifle's trigger; and the transfer block communicates that movement to the bottom surface of the lever.

* * * * *